US007140982B2

(12) United States Patent
Park

(10) Patent No.: US 7,140,982 B2
(45) Date of Patent: Nov. 28, 2006

(54) GOLF TEE HAVING A WIRE SUPPORT FOR A GOLF BALL

(76) Inventor: John J. Park, 28 Cheshire La., Yorktown Heights, NY (US) 10598

( * ) Notice: Subject to any disclaimer, the term of this patent is extended or adjusted under 35 U.S.C. 154(b) by 0 days.

(21) Appl. No.: 10/813,199

(22) Filed: Mar. 29, 2004

(65) Prior Publication Data

US 2005/0215343 A1 Sep. 29, 2005

(51) Int. Cl.
*A63B 57/00* (2006.01)

(52) U.S. Cl. ..... 473/387; 473/395

(58) Field of Classification Search ..... 473/387–403, 473/132; D21/717, 718; 248/565–567, 248/576, 599, 600, 601
See application file for complete search history.

(56) References Cited

U.S. PATENT DOCUMENTS

| | | | | |
|---|---|---|---|---|
| 1,181,507 | A * | 5/1916 | Cutts | 248/601 |
| 1,209,561 | A * | 12/1916 | Crease | 248/601 |
| 1,901,948 | A * | 3/1933 | Bock | 473/392 |
| 1,933,239 | A * | 10/1933 | Boe | 473/388 |
| 2,082,811 | A | 6/1937 | Thorup | |
| 2,451,311 | A | 10/1948 | Andreasen | |
| 2,466,115 | A * | 4/1949 | MacInnes et al. | 473/392 |
| 2,508,155 | A | 5/1950 | Gerlach | |
| 2,760,303 | A * | 8/1956 | Del Mas | 446/97 |
| 3,127,177 | A * | 3/1964 | Benkoe | 473/137 |
| D201,890 | S | 8/1965 | Dreyfus | |
| 3,347,551 | A | 10/1967 | Dreyfus | |
| 3,424,457 | A * | 1/1969 | Robertson | 473/396 |
| 3,782,723 | A | 1/1974 | Morris | |
| 3,947,027 | A | 3/1976 | Brown | |
| 4,004,814 | A * | 1/1977 | Blair | 473/392 |
| 4,192,504 | A | 3/1980 | Clugage | |
| D268,356 | S | 3/1983 | Brisebois | |
| 4,783,077 | A | 11/1988 | Lemon | |
| D306,194 | S | 2/1990 | Sadowski | |
| 5,193,803 | A | 3/1993 | Flick, III | |
| D348,498 | S | 7/1994 | Milliken | |
| 5,413,330 | A | 5/1995 | Disco et al. | |
| D376,182 | S | 12/1996 | Lusk | |
| 5,672,118 | A * | 9/1997 | Robbie | 473/396 |
| 5,683,305 | A * | 11/1997 | Andersson | 473/387 |
| 5,683,313 | A | 11/1997 | Disco et al. | |
| 5,738,598 | A | 4/1998 | Wu | |
| 6,004,228 | A | 12/1999 | Adam | |
| 6,062,990 | A | 5/2000 | Pierce | |
| D431,849 | S | 10/2000 | MacDonald | |
| 6,176,794 | B1 | 1/2001 | Kim | |
| D439,944 | S | 4/2001 | Graham | |
| D443,007 | S | 5/2001 | Schneider | |
| 6,500,077 | B1 * | 12/2002 | Wei | 473/397 |
| 2001/0029212 | A1 | 10/2001 | Dovigi | |

* cited by examiner

*Primary Examiner*—Steven Wong
(74) *Attorney, Agent, or Firm*—Mark Sgantzos; Martinez Group PLLC

(57) ABSTRACT

A support device having a support wire with a series of bends for supporting a golf ball from a golf tee, the support wire extending from and being attached to the side of the head of the tee or the side of a self-supporting base. The support wire also being attached to the tee or the self-supporting base by way of removable springs.

2 Claims, 5 Drawing Sheets

11
11a
12
10
1
4
5
2
3

Fig. 6
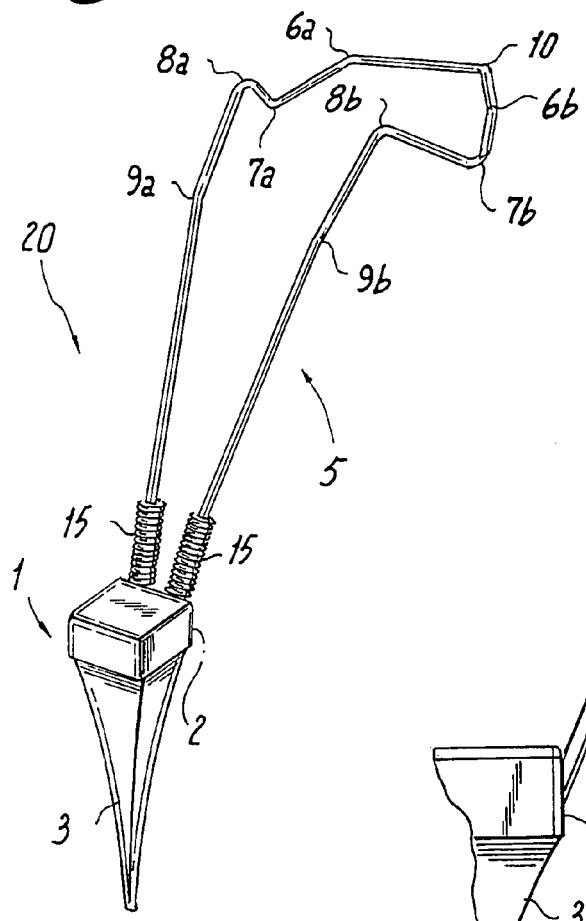
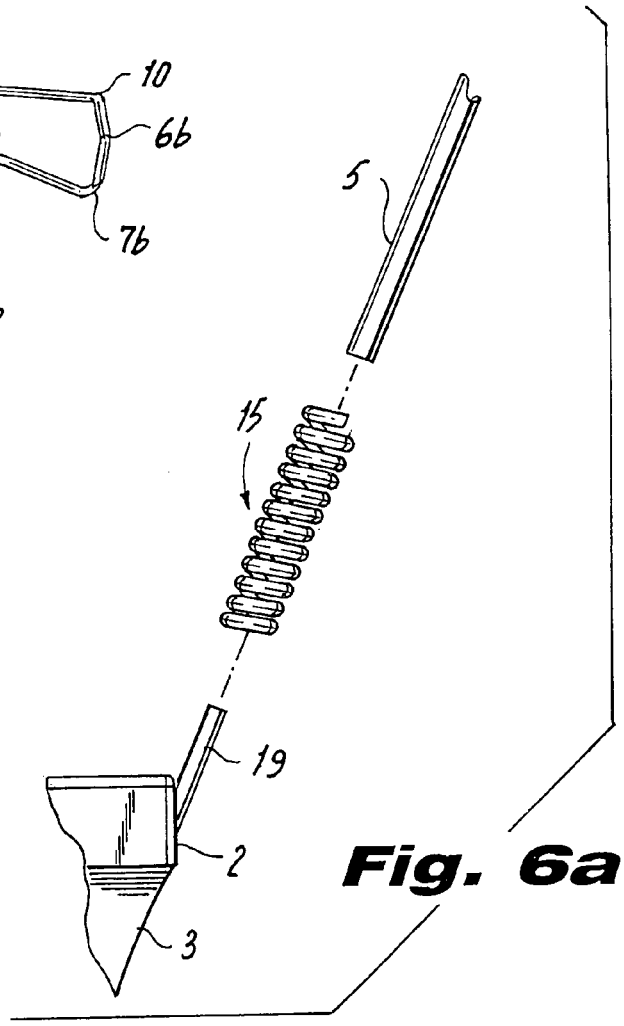
Fig. 6a
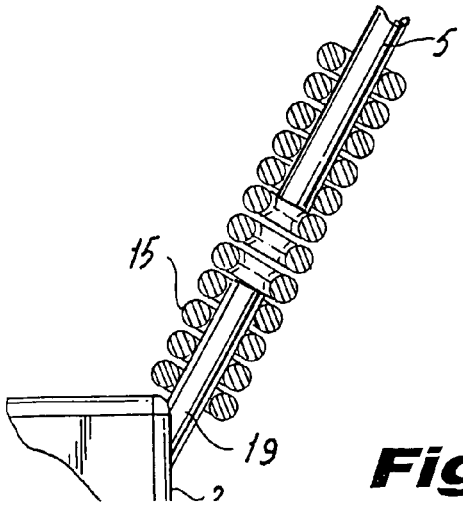
Fig. 6b

Fig. 7
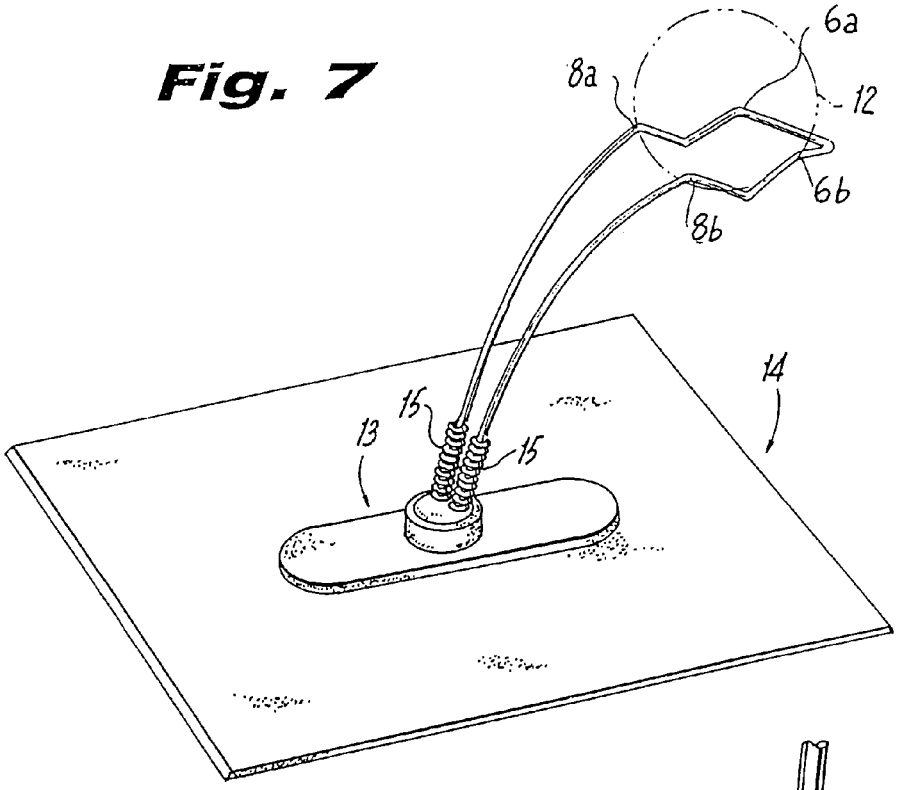
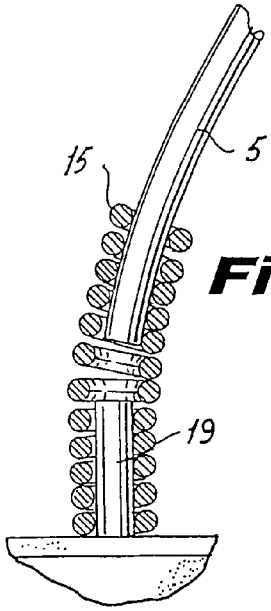
Fig. 7b
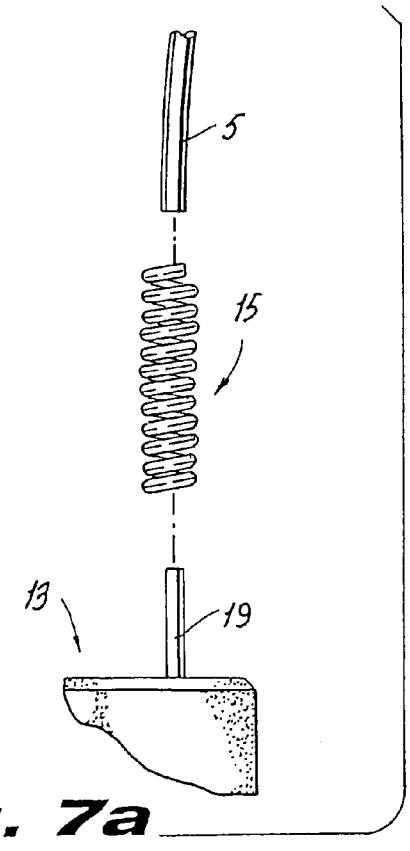
Fig. 7a

GOLF TEE HAVING A WIRE SUPPORT FOR A GOLF BALL

FIELD OF THE INVENTION

The invention relates to the field of supporting a golf ball so that a golf ball trajectory is not influenced as is by a traditional golf tee, and more particularly to a golf ball tee having a projecting support wire attached to the head of the tee adapted for supporting the said golf ball.

BACKGROUND OF THE INVENTION

A traditional golf tee is comprised of a conical spike portion for insertion into the ground and a head portion having a concave surface in which a golf ball is placed thereon. The insertion of the golf tee into the ground requires that the surface be level or made level prior to insertion of the spike portion so that the tee is level with the ground surface so that golf ball can reasonably be held level with the surface in which the tee is placed upon. Therefore, the golfer must take care of where the tee is to be placed. Further, a traditional golf tee provides for a tee which more often than not intrudes upon the swing path of the golf club, thus slowing down the golf club prior to striking the golf ball, such intrusion preventing the golf club from reaching the golf ball at a "true" velocity, or a velocity free from interference by a traditional golf tee or other golf ball suspending devices. In addition to the slowing of the golf club speed, a traditional tee can also influence the angle at which the club head impacts the ball, thus slightly twisting the golf club prior to striking the golf ball, by means of the tee striking either axial end of the golf club head striking surface. Twisting occurs when the golf club head is not perfectly aligned with the golf ball. If the club were to even slightly twist due to the influence of the golf tee, the intended direction of the golf ball would be greatly altered depending on the intended distance the ball would travel. The longer the flight path, the greater the distance the ball would deviate from its intended path. Lastly, a traditional golf tee does not provide a means by which a golf ball can be suspended, devoid of physical contact with a golf tee, prior to the instant of impact by a golf club. Suspending a golf ball, devoid of physical contact with a support device, prior to the ball being struck provides for the most equitable means in which a golfer's true skill can be displayed and subsequently refined with practice. Currently, the leveling of a golf ball on a golf tee, and insuring the golfer only strikes the golf ball and not the tee, is not convenient or possible with traditional golf tees.

It is an object of the present invention to provide a device for supporting a golf ball, which does not require careful surface placement of the golf tee.

It is a further object of the invention to provide a device, which supports a golf ball, but does not influence the trajectory of the golf ball.

It is further an object of the present invention to provide a device that prevents twisting of the golf club prior to striking the golf ball.

It is a further object of the present invention to provide a device, which supports the golf ball and does not come into contact with the portion of the golf club, which strikes the golf ball.

It is a further object of the present invention to provide a device which can be used both on a golf course and on a practice range.

It is a further object of the present invention to provide a device in which a support wire suspends a golf ball and is forced away from the golf ball prior to impact.

It is a further object of the present invention to provide a device in which the spring rate of the support wire can be adjusted.

SUMMARY OF THE INVENTION

The features and advantages of the present invention are achieved by providing a flexible support wire on a side head of a golf tee or a self-supporting base, which is capable of supporting and suspending a golf ball without physical contact prior to striking the ball, which is not possible with traditional golf tees.

The golf tee and support device of the instant invention is comprised of a golf tee having a spike portion, a head portion and a head side portion. The spike portion being configured for insertion into the ground, the head portion and the head side portion configured for supporting the ends of the flexible support wire. The support wire of the instant invention is comprised of a flexible yet rigid wire where both ends of the rigid wire are attached to the head side portion of the golf tee. The support wire also having a series of bends, which support the golf ball prior to being struck by the golf club. The support wire further having a pointed fold in the front and a series of matching bends along both sides of the wire to insure that the ball is supported in a stable manner prior to being struck by the golf club, the bends of the support wire defining a spoon shaped support portion which cradles the ball. The support wire lastly having a golf club head strike portion which when the strike portion comes into contact with the bottom of the golf club head, deflects away from the ball, thus separating the ball from the support wire prior to the ball being struck by the face of the golf club, in essence suspending the golf ball in mid-air. Such separation insuring that the tee does not decelerate nor change the angle in which the club strikes the golf ball, thus imparting a true trajectory intended by the golfer.

In a second embodiment of the instant invention, the support wire ends are secured to a self-supporting base and subsequently placed on a practice mat. The flexible support wire being adapted for use in practice ranges where a traditional tee having a spike cannot be inserted into the ground surface.

In a third embodiment of the instant invention, the support wire ends are secured to the tee or the self-supporting base by means of a removable spring which can be changed so as to change the rate at which the support wire moves away from the ball when the support wire comes into contact with the golf club.

The foregoing and other features and advantages of the present invention will be apparent from the following detailed description of the invention.

BRIEF DESCRIPTION OF THE DRAWINGS

FIG. 6 is a perspective view of a third embodiment of the present invention where the ends of the support wire are attached to the tee by a removable spring.

FIG. 6A is a perspective view of a third embodiment of the present invention illustrating the means by which the spring is attached to the tee and the support wire.

FIG. 6B is an elevation and partial section view of a third embodiment of the present invention.

FIG. 7 is a perspective view of a third embodiment of the present invention where the ends of the support wire are attached to a self-supporting base by a removable spring.

FIG. 7A is a perspective view of a third embodiment of the present invention showing the means by which the spring is attached to the self-supporting base and the support wire.

FIG. 7B is an elevation and partial section view of a third embodiment of the present invention.

DESCRIPTION OF THE PREFERRED EMBODIMENTS

Figure 1:
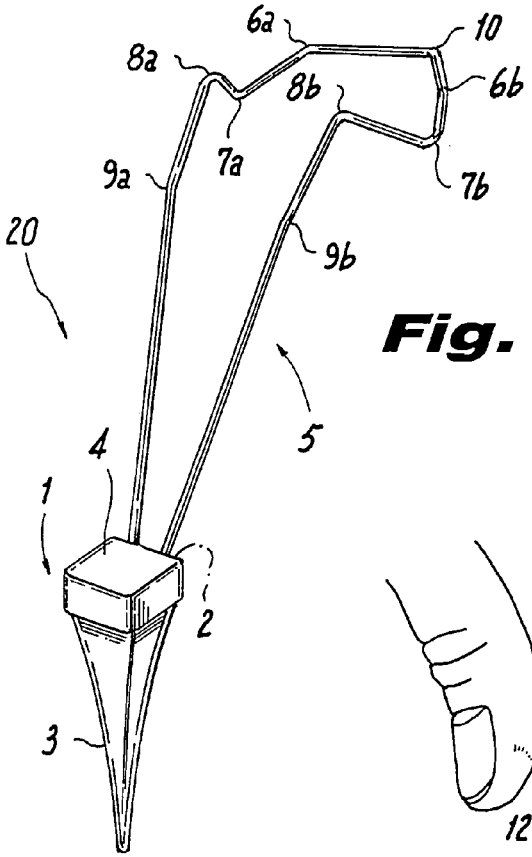
FIG. 1 is a perspective front view of the first embodiment of the golf tee in accordance with the teachings of the present invention.

Referring to the drawings in detail, there are illustrated therein various exemplary embodiments of the support device made in accordance with the teachings of the instant invention. These exemplary embodiments should not be construed as limiting.

Figure 2:
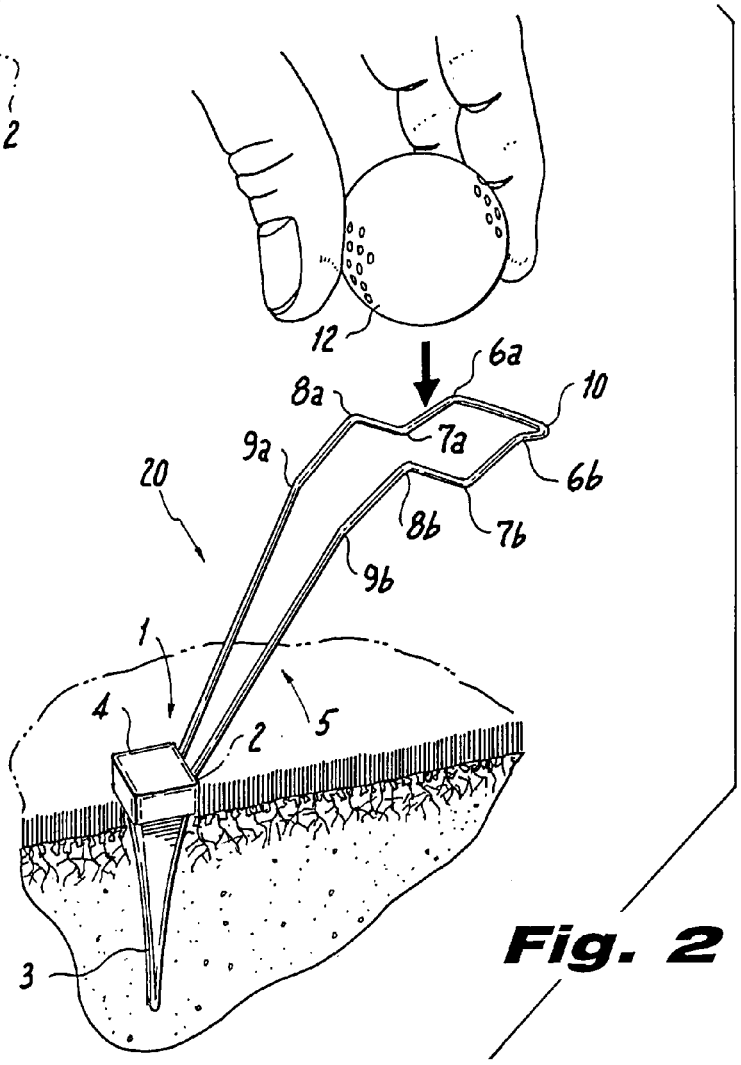
FIG. 2 is a perspective side view of the golf tee and the support wire.

Referring to FIGS. 1 and 2, the support device is generally denoted by reference numeral 20, which is comprised of a traditional tee 1, where the tee has a head portion 4, a head side portion 2, and a conical spike 3, extending from the bottom of the tee head. The support wire 5 of the support device 20 is further comprised of a series of pairs of bends 6*a*–9*b*, which form a spoon-shaped portion culminating at a folded point 10 at the end of the support wire. The ends of the support wire being inserted into the head side portion 2, so as to form the support device. The formation of the support wire begins from the point 10 (midpoint of the support wire), which is folded to form a point having approximately a 70-degree angle between the two lengths of the support wire. A first series of bends 6*a* and 6*b* are then formed at an approximately 150-degree angle with respect to the wire length, which folds the point 10 downwards. A second series of bends 7*a* and 7*b* are then bent approximately 150 degrees with respect to the wire length so as to bring the point 10 upwards and in line with the remaining equidistant lengths of support wire. A third series of bends 8*a* and 8*b* are then bent inwards at approximately 120 degrees and downwards at approximately 160 degrees so as to form a spoon shape which provides a ball support area before the ball leaves the support wire. A fourth set of bends 9*a* and 9*b* are then formed at a 170-degree angle with respect to the remaining length of the equidistant wires, thus orienting the point 10 downward to provide a semi-level area defined by the bends 6*a*–8*b*. The ends of the support wire are then inserted into the head side 2 of the golf tee and taper inwardly from the spoon shaped portion. The series of bends 6*a*–8*b* as described above form the ball support surface where the ball is launched therefrom.

Figure 3:
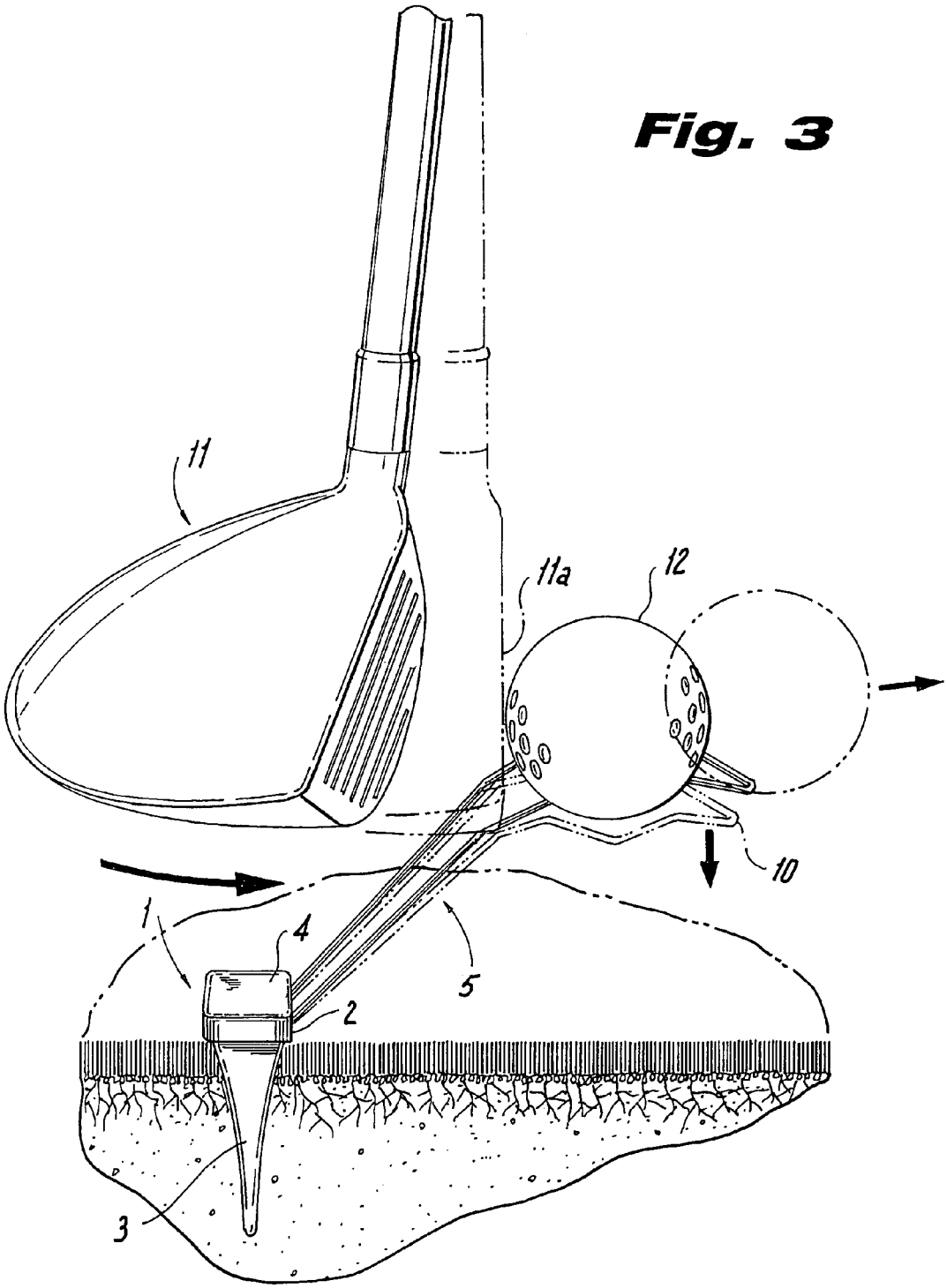
FIG. 3 is a side view of the tee when the golf ball is struck by a golf club, which illustrates the support wire deflection.
Figure 4:
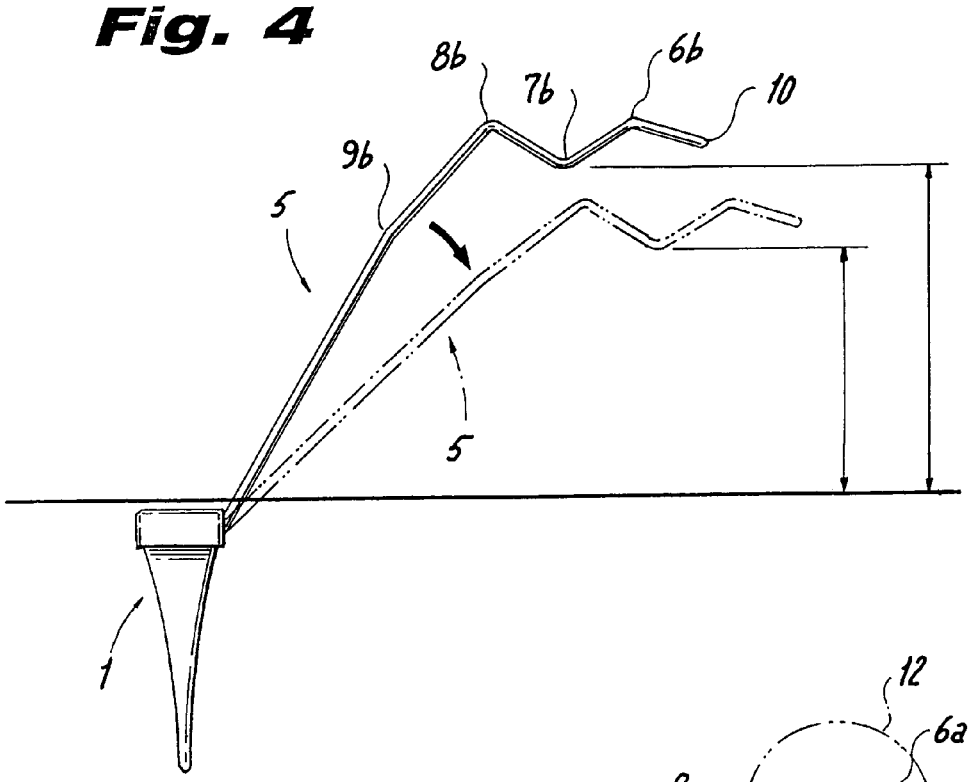
FIG. 4 is a side view of the support wire illustrating the deflection of the support wire.

In use, the ball is placed on the spoon shaped portion as defined by bends 6*a*–8*b*. The ball is thusly only in contact with the points of the bends 6*a*–8*b*. As shown in FIG. 3, when the golf club head 11 is swung towards the golf ball 12, the bottom of the golf club head 11 comes into contact with the support wire between portions 9*a*–8*b* and thusly forces the support wire to deflect downwards toward the ground surface prior to the head coming into contact with the ball. Thus, the golf ball 12, prior to contact with the golf club, is momentarily suspended and is not in contact with the support wire. The deflection of the support wire away from the ball and the club head face 11*a*, which strikes the ball, prevents deviation of the ball caused by traditional tees and insures that only the ball will be struck by the face 11*a*. FIG. 3 shows the support wire 5 deflecting approximately half the height of the golf club head (distance between the point of the head which comes into contact with the ball and the bottom most portion of the head which comes into contact with the support wire). FIG. 4 shows the support wire being infinitely adjustable and thus, accommodates the use of golf clubs having different size heads, since the support wire will deflect along the bottom of the club head.

The bends 6*a*–9*b* as described above are of utmost importance to the instant invention since the series of bends insure that the ball is supported in a stable manner at four points and travels an intended flight path by not being hindered by the support wire since the support wire is deflected away from the golf club and the golf ball. The bends as described above compensate for the undesirable deviation of the ball due to a golf strike at an angle other than that of which is aligned with the support wire.

Figure 5:
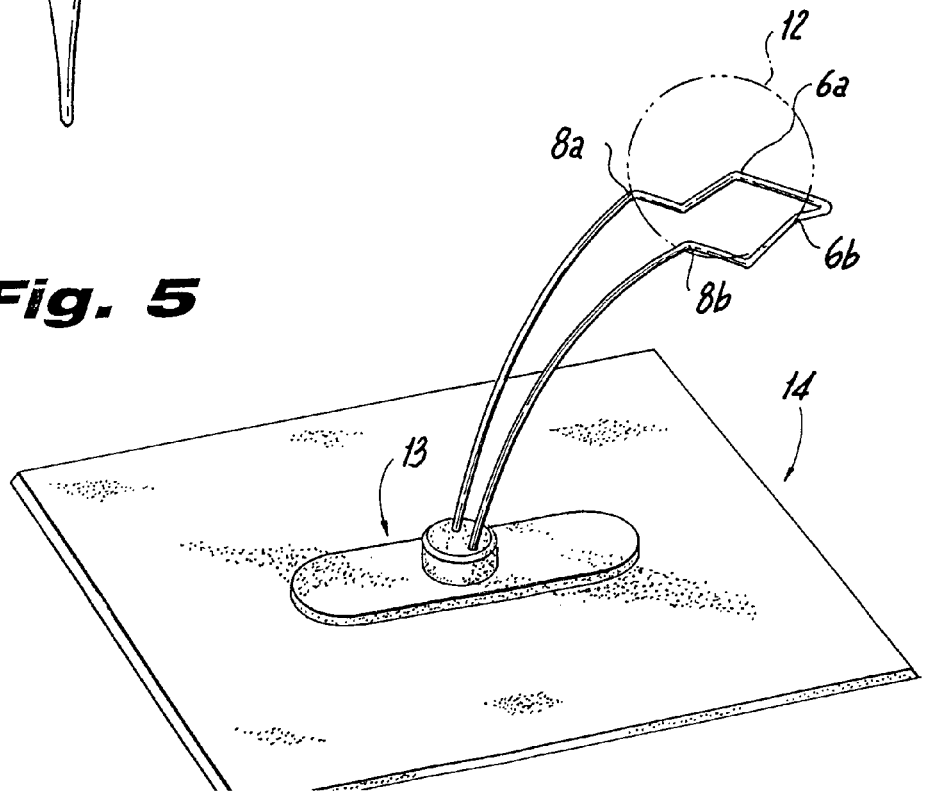
FIG. 5 is a perspective view of a second embodiment of the present invention where the ends of the support wire are attached to a self-supporting base and subsequently placed on a practice mat.

Referring to a second embodiment of the instant invention as shown in FIG. 5, the support device as shown is comprised of a support wire substantially the same as that of the first embodiment with the exception that the support wire is not connected to the head of the golf tee but a self-supporting base 13. The support wire of the second embodiment contemplates the connection of the support wire to a self-supporting base 13 on a practice mat 14. The self supporting base affords the user a practice support device which can be used when the weather is inhospitable or the ground surface does not facilitate the insertion of a tee into the ground.

Referring to a third embodiment of the instant invention as shown in FIGS. 6–7B, the support device as shown is comprised of a support wire substantially the same as that of the first and second embodiments with the exception that the support wire is removeably attached to the tee 1 and base 13 by means of springs 15. The springs 15 being removeably attached to the tee 1 and the base 13 by means of posts 14 which extend out of the tee 1 and base 13 respectively. Each of the springs mating to the posts 14 and subsequently attached to the ends of the support wire. The springs being removeably attached by having the inside diameter of the springs slightly smaller than that of the outside diameter of the ends of the support wire and the posts, whereby an interference fit is established between the springs, the posts and the ends of the support wire. The springs can be changed to provide for differing spring rates so that the rate at which the support wire separates from the golf ball can be altered to accommodate differing configurations of golf club heads and golf club head speeds.

As described above, the support device of the instant invention provides a number of advantages, some of which have been described above and others, which are inherent in the instant invention. Modifications may be proposed to the support device without departing from the teachings herein such as changing the shape and orientation of the bends to specifically suit a certain type of golf club, or changing the number of bends so that the ball is better supported before being struck. Accordingly, the scope of the invention is only to be limited as necessitated by the accompanying claims.

I claim:

1. A support device for supporting a golf ball, comprising: a support structure; and a rigid support wire having at least one bend where the ends of the wire are attached to the support structure by means of a pair of springs, wherein the rigid support wire is folded at a point and having a series of four sets of bends forming a deformable strike portion and a spoon shape portion in which a golf ball is directly supported on the spoon shaped portion of the rigid support wire and wherein the springs are attached to the support structure by means of a pair of posts extending from the support structure, the springs being removeably attached to the posts and the support wire ends.

2. The support device as defined in claim 1, wherein the rigid guide wire is deflected away from the golf ball prior to a golf club head striking the golf ball.

* * * * *